United States Patent [19]

Larsen et al.

[11] 4,394,013

[45] Jul. 19, 1983

[54] APPARATUS FOR BASKETBALL

[75] Inventors: James E. Larsen, Lincoln, Nebr.; Charles E. Rogers, Akron, Ohio

[73] Assignee: Randall Industries, Inc., Akron, Ohio

[21] Appl. No.: 383,118

[22] Filed: May 28, 1982

[51] Int. Cl.[3] ..... A63B 71/02

[52] U.S. Cl. ..... 273/1.5 R

[58] Field of Search ..... 273/1.5 R, 1.5 A

[56] References Cited

U.S. PATENT DOCUMENTS 4,161,313 7/1979 Dickey ..... 273/1.5 A 4,164,928 8/1979 Meares ..... 273/1.5 R X

*Primary Examiner*—Paul E. Shapiro

*Attorney, Agent, or Firm*—Mack D. Cook, II

[57] ABSTRACT

Apparatus to accept, hold and release a basketball in game playing situations requiring a "jump ball". The primary components of the apparatus are: a suspension frame; a telescoping elevator unit carried beneath the frame; a basketball accepting, holding and releasing mechanism carried coaxially within the elevator unit; a hoist mechanism for the elevator unit; and, an electrical system for actuating ball release and the hoist mechanism and for signalling the operative condition of the apparatus.

4 Claims, 4 Drawing Figures

APPARATUS FOR BASKETBALL

BACKGROUND OF THE INVENTION

The invention relates to an apparatus to accept, hold and release a basketball in game playing situations requiring a "jump ball". The apparatus is intended to eliminate the effects of human variation in putting a basketball into play at the start of a game, at the beginning of each half or period or any time a jump ball is called for by an official according to the applicable playing rules.

Like any other game, the playing rules for basketball are subject to change, from season to season. Recently, college basketball has followed professional basketball in trying to speed up the "time of game" by using an "alternate possession rule", rather than the traditional jumpball. The inventor has determined that the jumpball may return to the game of basketball at all levels of play, if the apparatus of the invention is widely installed and used.

The scope and content of the prior art has been determined. Prior art patent AF, U.S. Pat. No. 4,164,928, 8/1979, Meares, states,—At the high school, college and professional level one of the most heard complaints by coaches relates to the inconsistency of the referee's basketball toss during a "jump ball" situation.

SUMMARY OF THE INVENTION

The object of the invention is to provide an apparatus which will eliminate the effects of human variation and the resultant inconsistency of a referee's basketball toss during a "jump ball" situation.

A further object of the invention is to provide an apparatus for basketball which may be installed in new or existing buildings, which will be easy to operate and maintain, and which contributes to better play of the game of basketball.

These and other objects of the invention, as well as the operating advantages thereof will be apparent in view of the following drawings and specification.

The apparatus according to the invention is installed for use above a playing court for the game of basketball. The apparatus has a combination of components. A suspension frame is adapted to be secured to a ceiling or structural support above the court. A telescoping elevator unit, suspended beneath the frame, has a plurality of coaxially interfitting segments including an outer segment and an inner segment. The outer segment has an upper end adapted to be secured to the frame. A basketball mechanism carried coaxially of the elevator unit inner segment has arcuately moving paddles for accepting and holding a basketball. The paddles are interconnected by a motion linkage to a linkage actuator for selective movement of the paddles to drop a held basketball toward the playing court. A hoist mechanism mounted on the frame has a cable trained down and through the elevator unit. The free end of the hoist cable is connected to the basketball mechanism. An electrical system selectively energizes the hoist mechanism to raise or lower the elevator unit by movement of the basketball mechanism, and selectively energizes the linkage actuator of the basketball mechanism.

THE DRAWINGS

Figure 1:
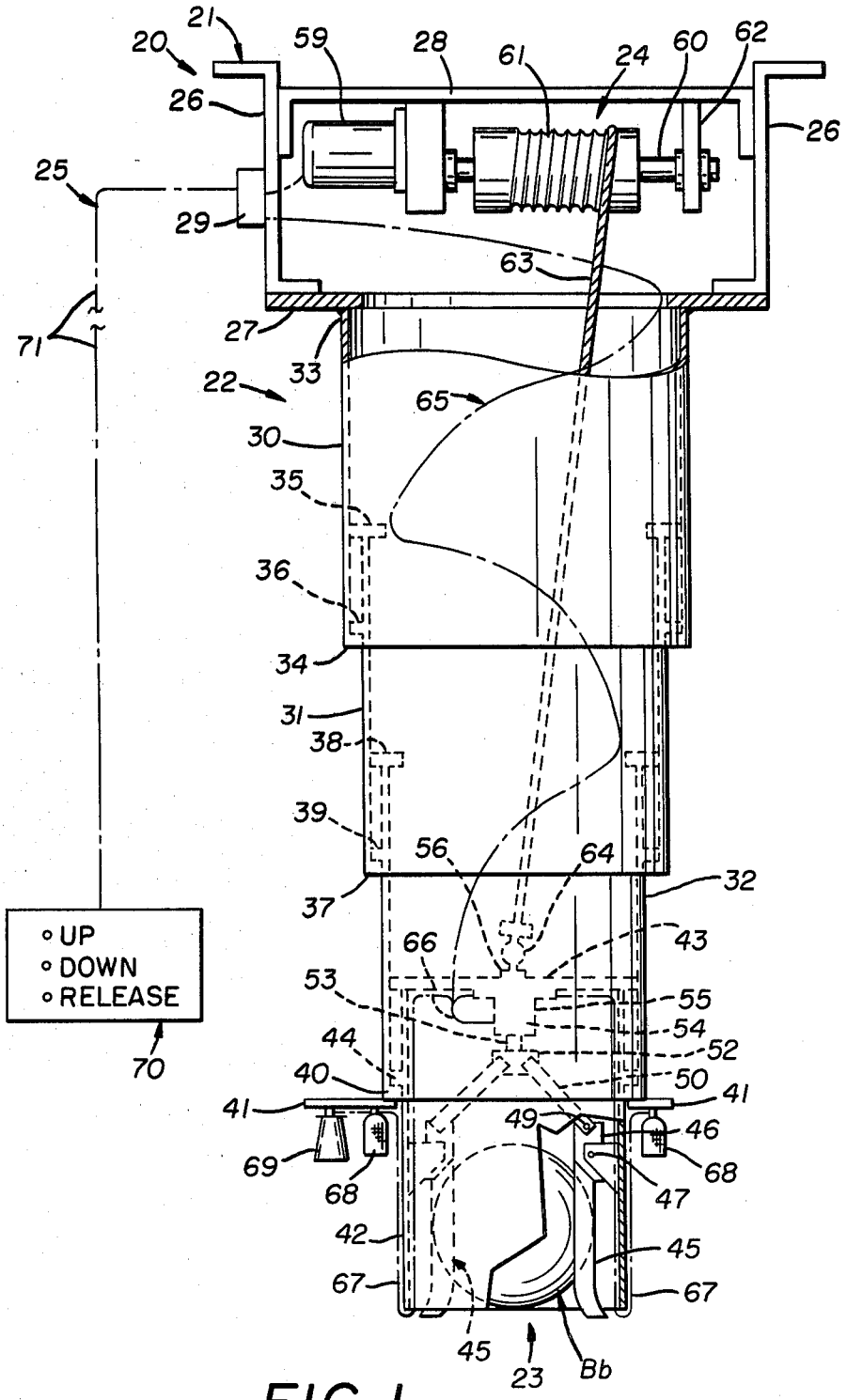
FIG. 1 is a side view of an apparatus according to the invention in fully lowered condition.
Figure 2:
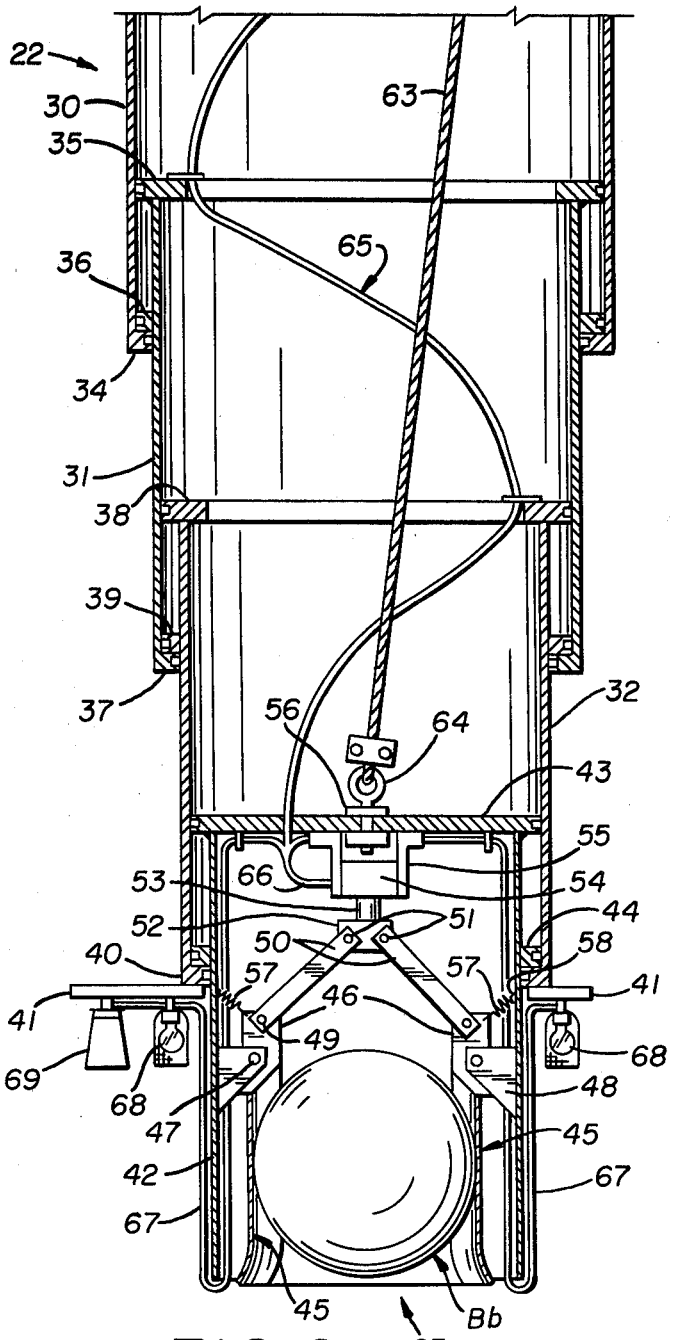
FIG. 2 is an enlarged sectional view of the apparatus in the lowered condition.
Figure 3:
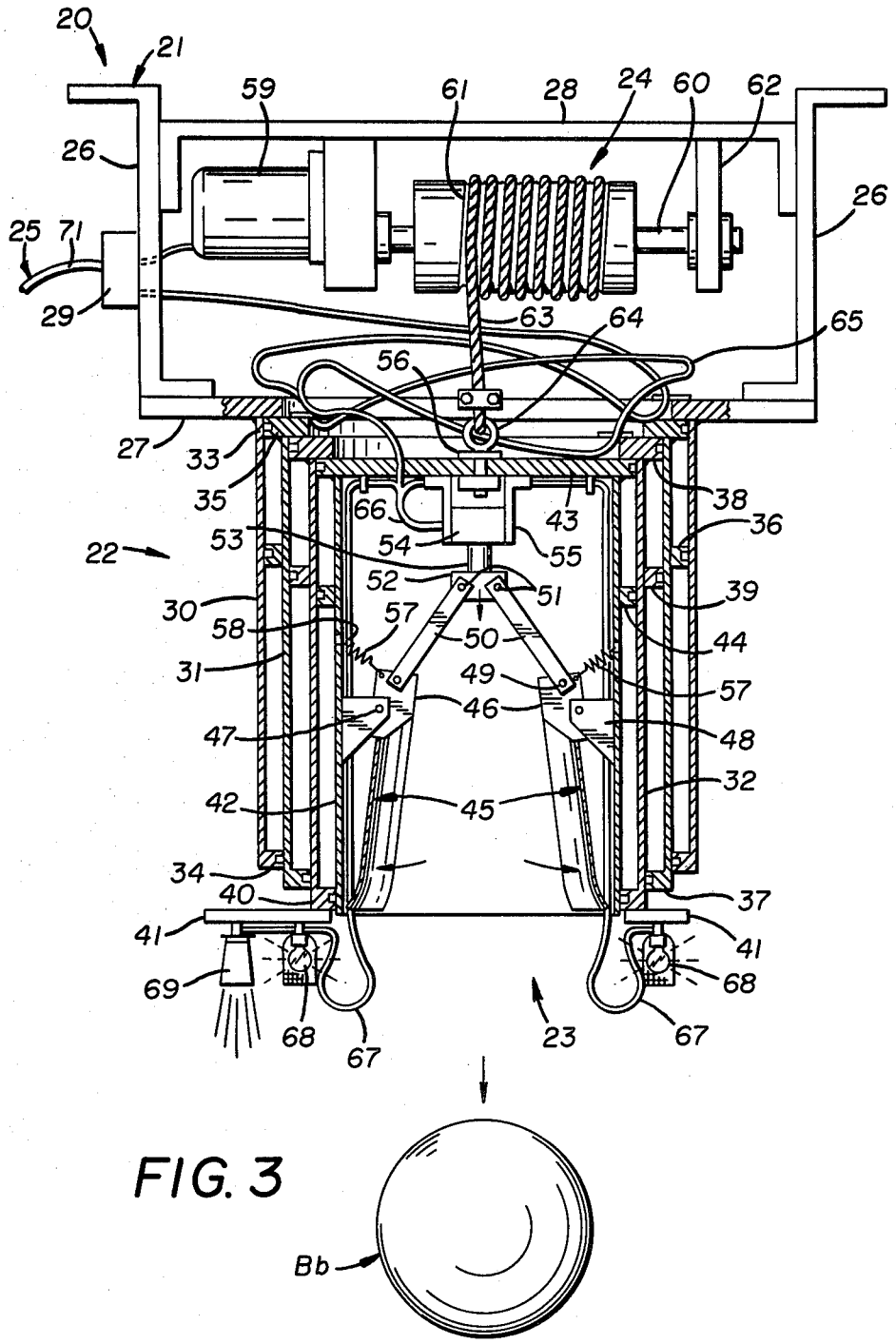
FIG. 3 is another sectional view of the apparatus in the raised condition.
Figure 4:
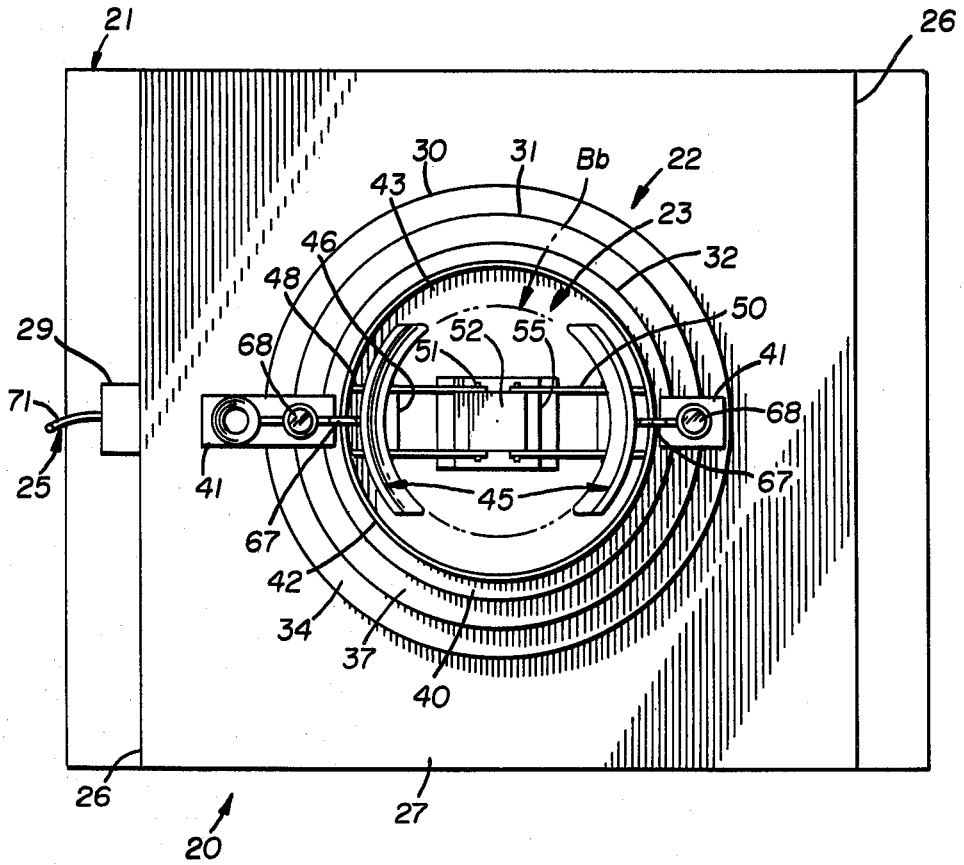

and FIG. 4 is a view from underneath the apparatus.

DETAILED DESCRIPTION OF THE INVENTION

An apparatus according to the invention is referred to generally by the numeral 20. The function and purpose of the apparatus 20 is to accept, hold and release a basketball (Bb) in game playing situations requiring a "jump ball".

A Bb apparatus 20 has five primary or basic components: A suspension frame 21; a telescoping elevator unit 22 carried beneath the frame 21; a basketball accepting, holding and releasing mechanism 23 carried coaxially within the elevator unit 22; a hoist mechanism 24 for the elevator unit 22; an electrical system 25 for actuating the ball release function of mechanism 23 and the hoist mechanism 24, and signalling the operative condition of the apparatus 20.

THE SUSPENSION FRAME 21

The apparatus 20 will be used in an auditorium, a gymnasium, a coliseum or "hall", above a regulation size playing court for the game of basketball. Three locations for the apparatus 20 are preferred: directly over the center jump circle and the jump circles in each court half. The exact structural configuration of each frame 21 will be individually and critically determined by the architectural design of the hall ceiling or structural support above the playing court.

As shown, the frame 21 has parallel side channels 26 adapted to be secured to the hall ceiling (not shown). The channels 26 carry a bottom plate 27 for suspension mounting the elevator unit 22. Extending between the channels 26 is a base 28 for mounting the hoist mechanism 24. One channel 26 mounts a junction box 29 for interconnection of the electrical system 25 with a remote electrical power source (not shown).

THE TELESCOPING ELEVATOR UNIT 22

As shown, the telescoping elevator unit 22 has three coaxially interfitting cylindrical segments: an outer segment 30; a medial segment 31; and an inner segment 32.

The upper end 33 of the body of outer segment 30 is adapted to be secured to the suspension frame plate 27. The lower end of the outer segment 30 carries a reduced diameter inwardly projecting stop shoulder 34.

The body of medial segment 31 has an outer diameter slightly less than (almost, coincident with) the inner diameter of the outer segment shoulder 34. The upper end of segment 31 carries an outwardly projecting stop flange 35 having an outer diameter slightly less than the body diameter of outer segment 30. The body of segment 31 carries a spacer ring 36 having the same effective diameter as the stop flange 35. The vertical distance between the stop flange 35 and the spacer ring 36 determines the telescoped position of medial segment 31 within outer segment 30 when the elevator unit 22 is lowered with the spacer ring 36 in contact with the outer segment stop shoulder 34. The lower end of segment 31 carries a reduced diameter inwardly projecting stop shoulder 37.

The body of inner segment 32 has an outer diameter slightly less than (almost, coincident with) the inner diameter of the medial segment shoulder 37. The upper end of segment 32 carries an outwardly projecting stop flange 38 having an outer diameter slightly less than the body diameter of medial segment 31. The body of segment 32 carries a spacer ring 39 having the same effective diameter as the stop flange 38. The vertical distance between the stop flange 38 and the spacer ring 39 determines the telescoped position of inner segment 32 within medial segment 31 when the elevator unit 22 is lowered with the spacer ring 39 in contact with the medial segment stop shoulder 37. The lower end of segment 32 carries a reduced diameter inwardly projecting stop shoulder 40. The lower end of segment 32 also carries a signal plate 41 for mounting components of the electrical system 25.

If required by the distance from the playing court to the hall ceiling or structural support, the elevator unit 22 may have more than one medial segment 31.

THE BASKETBALL MECHANISM 23

The mechanism 23, for accepting, holding and releasing a basketball, cooperatively functions with the telescoping elevator unit 22, but also is an independently operating component of the apparatus 20. Controlled vertical movement of the mechanism 23 by the hoist mechanism 24 will selectively raise and lower the elevator unit 22. However, a significant increment of vertical movement of the mechanism 23, independent of any vertical movement of the elevator unit 22, is left for discretionary determination by the operator of the apparatus 20.

As shown, the primary axial component of the mechanism 23 is a cylindrical segment 42. The upper end of segment 42 carries a preferably circular crossplate 43 having an outer diameter slightly less than (almost, coincident with) the body diameter of inner elevator segment 32. The body of segment 42 carries a spacer ring 44 having the same effective diameter as the crossplate 43. The vertical distance between the crossplate 43 and the spacer ring 44 determines the downward extent of projection of the mechanism 23 below the elevator unit 22.

The mechanism 23 has opposed suitably contoured arcuately movable paddles indicated at 45 for accepting and holding a basketball. Each paddle carries an upwardly projecting lever 46. Each paddle lever 46 is connected, as at pivot point 47, to a fulcrum bracket 48. Each fulcrum bracket 48 is secured on the inner face of the mechanism segment 42, below the position of a spacer ring 44.

Each paddle lever 46 is further connected, as at an upper pivot point 49 above a pivot point 47, to the lower end of an angularly directed (as shown, normally at approximately 45°) motion linkage arm 50. The upper end of each linkage arm 50 is connected, as at pivot point 51, to a common motion linkage block 52. The linkage block 52 is secured to a movable core shaft 53. The core shaft is an integral component of a motion linkage actuator indicated at 54.

As shown, the linkage actuator 54 is a conventional single-acting electromagnetic solenoid having a normally extended core shaft 53. The linkage solenoid 54 is carried by a mounting bracket 55 secured coaxially of the mechanism crossplate 43. Above the bracket 55, the crossplate 43 has a coupling boss 56 for connection of the basketball mechanism 23 to hoist mechanism 24.

During use of the apparatus 20, after the held basketball is dropped toward the jump circle, as by drawing the core shaft 53 into the core of the linkage solenoid 54, the paddles 45 are mechanically biased to swing arcuately inwardly on pivot points 47 to accept the next basketball. As shown, a tension spring 57 is connected between the upper outside corner of each paddle lever 46 to a small block 58 secured on the inner face of the mechanism segment 42, below the position of a spacer ring 44 and above the fulcrum brackets 48.

THE HOIST MECHANISM 24

As shown, the hoist mechanism 24 has a reversible gearhead electric motor 59 mounted beneath the frame base 28. The motor 59 drives a shaft 60 carrying a cable drum 61. The outer end of the drive shaft 60 is journaled in a bearing block 62 secured beneath the frame base 28. A hoist cable 63 is trained from the drum 61 down and through the frame plate 27 and the elevator unit segments 30,31 and 32. The free end of the hoist cable 63 carries an eyebolt 64 for threaded connection with the coupling boss 56 on the basketball mechanism crossplate 43. The hoist cable 63 will raise or lower the elevator unit 22 by selective movement of the basketball mechanism 23.

THE ELECTRICAL SYSTEM 25

The electrical system 25 includes conventional wiring extending out of the frame junction box 29 to energize the hoist drive motor 59 for bi-directional rotation of the cable drum 61.

The electrical system 25 also includes an actuator cable indicated at 65 extending from the junction box 29 to basketball mechanism 23. The cable 65 splits into one length 66 of conventional wiring to energize the linkage solenoid 54 and two lengths 67 of conventional wiring to energize lights 68 and horn 69, mounted on the inner segment signal plate 41.

The electrical system also includes a remote control box indicated at 70 to control the apparatus 20 above the basketball playing court. The control box 70 is connected to the frame junction box 29 by a control cable indicated at 71. The control box 70 has an "up button" energizing the hoist mechanism 24 to raise the basketball mechanism 23 and telescope the elevator unit 22, a "down button" energizing mechanism 24 to lower mechanism 23 and extend unit 22, and a "release button" to energize the linkage solenoid 54 and the signal lights and horn, 68 and 69.

What is claimed is:

1. Apparatus for use above a playing court for the game of basketball, comprising: a suspension frame adapted to be secured to a ceiling or structural support above the court; a telescoping elevator unit suspended beneath said frame and having a plurality of coaxially interfitting segments including an outer segment and an inner segment, said outer segment having an upper end adapted to be secured to said frame; a basketball mechanism carried coaxially of said elevator unit inner segment and having arcuately moving paddles to accept and hold a basketball, said paddles being interconnected by a motion linkage to a linkage actuator for selective movement to drop a held basketball toward the playing court; a hoist mechanism mounted on said frame and having a cable trained down and through said elevator unit, the free end of said cable being connected to said basketball mechanism; and, an electrical system to selectively energize said hoist mechanism to raise or lower said elevator unit by movement of said basketball mechanism, and to selectively energize said linkage actuator of said basketball mechanism.

2. Apparatus according to claim 1, wherein: said suspension frame has channels for securing to a ceiling or structural support, a bottom plate carried by said channels for suspension mounting said elevator unit, a base extending between said channels for mounting said hoist mechanism, and a junction box mounted on a channel for interconnection of said electrical system with a remote power source.

3. Apparatus according to claim 1, wherein: said elevator unit segments are cylindrical and said outer and inner segments are interconnected by at least one medial segment.

4. Apparatus according to claim 1, wherein: said elevator unit segments are cylindrical; and the primary axial component of said basketball mechanism is a cylindrical segment having a cross-plate with an outer diameter slightly less than the body diameter of said elevator unit inner segment, there being two said arcuately moving paddles pivotally mounted by fulcrum brackets secured on the inner face of said cylindrical segment and having an upwardly projecting lever, each said paddle lever being pivotally connected to a common motion linkage block, said linkage block being connected to said motion actuator carried by said cylindrical segment crossplate.

* * * * *